US005250984A

United States Patent [19]

Masai

[11] Patent Number: 5,250,984

[45] Date of Patent: Oct. 5, 1993

[54] IMAGE FORMING SYSTEM INCLUDING IMAGE FORMING APPARATUS WHICH COMMUNICATES WITH AN IC CARD OVER A MAGNETIC FLUX CARRIER

[75] Inventor: Katsunori Masai, Amagasaki, Japan

[73] Assignee: Mita Industrial Co., Ltd., Japan

[21] Appl. No.: 874,109

[22] Filed: Apr. 27, 1992

[30] Foreign Application Priority Data

May 2, 1991 [JP] Japan ..... 3-130348

[51] Int. Cl.[5] ..... G03G 21/00

[52] U.S. Cl. ..... 355/202; 355/209

[58] Field of Search ..... 355/200, 202, 204, 209, 355/210

[56] References Cited

U.S. PATENT DOCUMENTS 4,882,604 11/1989 Kato et al. ..... 355/202 X
4,970,550 11/1990 Hirayama ..... 355/200
4,990,954 2/1991 Higashio et al. ..... 355/200
5,030,990 7/1991 Iwaki et al. ..... 355/210 X
5,146,493 9/1992 Kiguchi et al. ..... 379/357

*Primary Examiner*—Fred L. Braun
*Attorney, Agent, or Firm*—Beveridge, DeGrandi, Weilacher & Young

[57] ABSTRACT

An image forming apparatus and an IC card are provided with a function of transmitting a signal with no contact with each other in a signal receivable range in order to prevent copying aggregation from being omitted due to forgetting to insert the IC card and to prevent the IC card from being left attached after a copying operation is completed. The image forming apparatus is brought into a condition where an image forming operation can be performed by receiving a signal from the IC card which is brought into the signal receivable range.

15 Claims, 9 Drawing Sheets

IMAGE FORMING SYSTEM INCLUDING IMAGE FORMING APPARATUS WHICH COMMUNICATES WITH AN IC CARD OVER A MAGNETIC FLUX CARRIER

BACKGROUND OF THE INVENTION

1. Field of the Invention

The present invention relates to an image forming system such as an electrophotographic copying machine and a printer, and more particularly, to an image forming system for controlling an image forming apparatus by use of an IC card (a card provided with a semiconductor integrated circuit).

2. Description of the Prior Art

Verification of a user's identification and management of information on the user with respect to a copying machine have conventionally been performed by use of a memory type IC card. In this case, the IC card performs its function in a condition where it is attached to the copying machine.

In a system where the IC card is attached to the copying machine as mentioned above, however, not only the user has to insert and draw out the IC card but also there are possibilities that aggregation of copying is omitted due to forgetting to insert the IC card and that the IC card is stolen due to leaving the IC card attached to the image forming apparatus.

SUMMARY OF THE INVENTION

An object of the present invention is to provide an image forming system where an image forming apparatus can be controlled without an IC card being inserted into or drawn out of the image forming apparatus.

To achieve the above-mentioned object, an image forming system of the present invention is provided with an image forming apparatus including a signal receiving portion and controlling means for causing said image forming apparatus to be brought into an image formation ready condition, and an IC card including a signal transmitting portion for transmitting a signal received by said signal receiving portion of said image forming apparatus with no contact therewith in a signal receivable range of said signal receiving portion.

According to the above-mentioned system, since the image forming apparatus is brought into a condition where an image forming operation can be performed when the user who is holding the IC card approaches the image forming apparatus, the user can make the image forming apparatus to form an image only by operating an operation key of the image forming apparatus.

BRIEF DESCRIPTION OF THE DRAWINGS

This and other objects and features of this invention will become clear from the following description taken in conjunction with the preferred embodiments with reference to the accompanied drawings in which.

DESCRIPTION OF THE PREFERRED EMBODIMENTS

Figure 1:
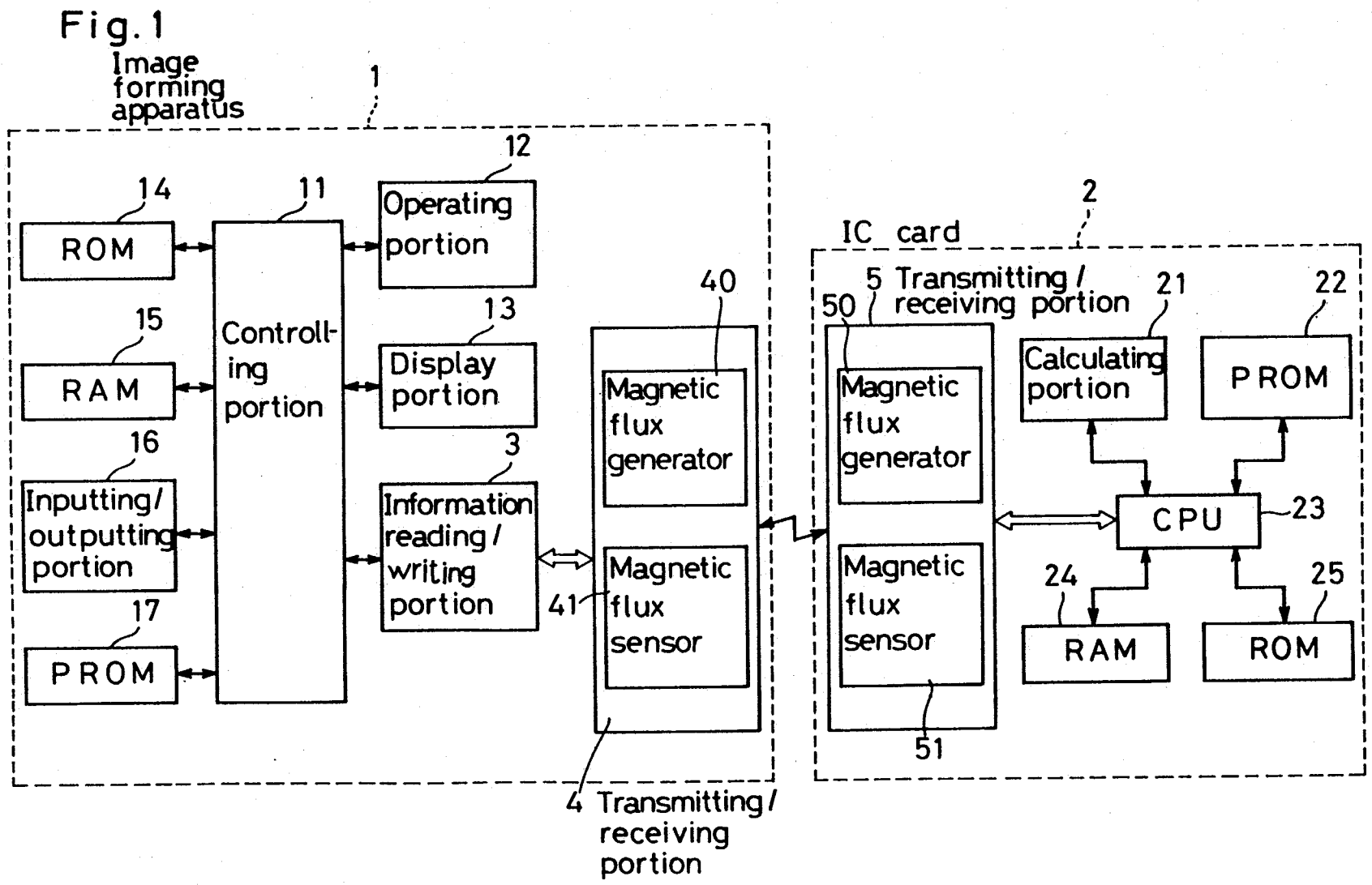
FIG. 1 is a block diagram of an image forming system embodying the present invention.

The present invention will hereinafter be described with reference to the embodiments shown in the drawings. In an image forming system shown in FIG. 1, an image forming apparatus 1 and an IC card 2 have transmitting/receiving portions 4 and 5, respectively. The transmitting/receiving portions 4 and 5 include magnetic flux generators 40 and 50 for transmitting a signal and magnetic flux sensors 41 and 51 for receiving a signal, respectively. The image forming apparatus 1 has an information reading/writing portion 3 which is connected to the transmitting/receiving portion 4 and a controlling portion 11. The controlling portion 11 is further connected to a ROM (read only memory) 14 where an operation controlling program is stored, a RAM (random access memory) 15 for working, an inputting/outputting portion 16 and a PROM (programmable read only memory) 17 as well as an operating portion 12 and a displaying portion 13. The controlling portion 11 also exchanges signals with these devices and portions. The operating portion 12 is provided with a copy key (or print key) and an interrupt key.

On the other hand, the IC card has a CPU (central processing unit) 23. The CPU 23 is connected to a calculating portion 21, a PROM 22, a RAM 24, a ROM 25 and a transmitting/receiving portion 5. An identification code of the IC card is stored in the PROM 22. The CPU 23 reads the identification code and provides it to the transmitting/receiving portion 5.

Figure 2:
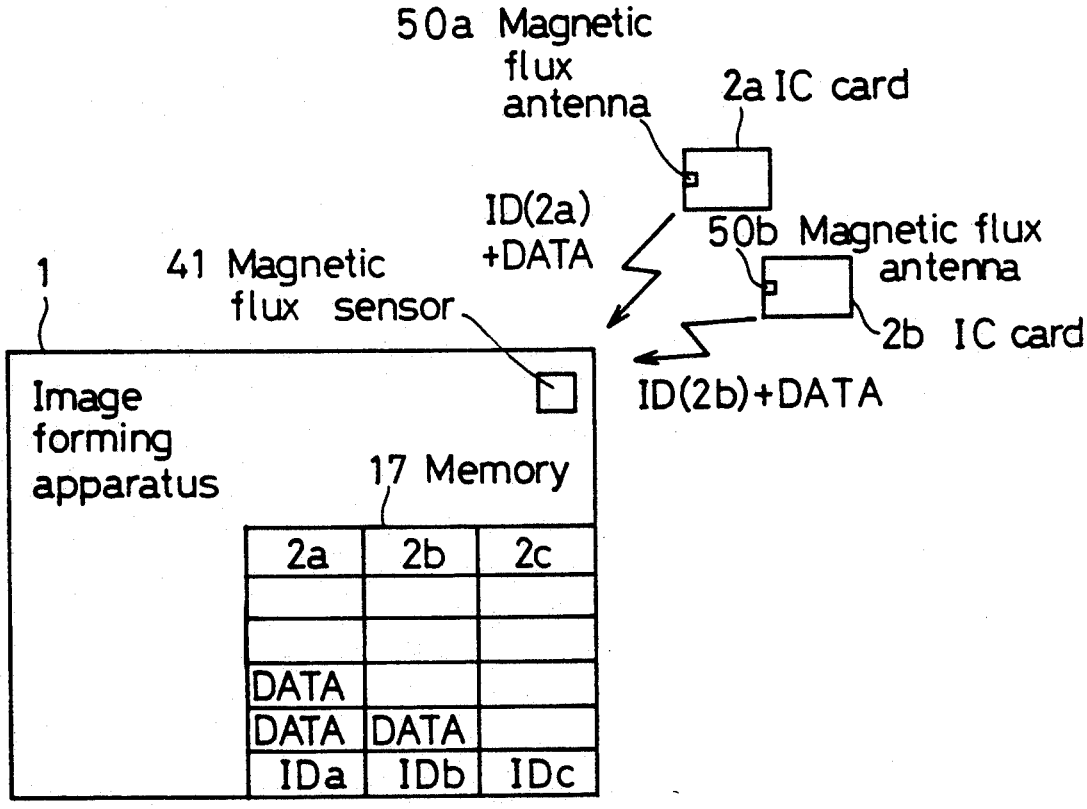
FIG. 2 shows a condition of a signal transmission from an IC card to an image forming apparatus in the system of FIG. 1.

As shown in FIG. 2, data on the IC card are provided in the areas, for IC cards 2*a*, 2*b*, . . . , of the PROM 17 of the image forming apparatus. As one kind of the data, identification code data IDa, IDb, . . . of respective IC cards are stored. The IC cards 2*a* and 2*b* put the identification code data IDa and IDb on magnetic fluxes generated by magnetic flux antennas 50*a* and 50*b* to transmit them. The image forming apparatus 1 and each of the IC cards 2*a* and 2*b* can exchange signals with each other only within a predetermined range (signal receivable range) to which a signal is fully transmitted. Therefore, according to this embodiment, in controlling the image forming apparatus 1 by use of an IC card, it is unnecessary to attach the IC card to the image forming apparatus 1.

In FIG. 2, the image forming apparatus 1 receives a magnetic flux generated by the IC card 2*a* or 2*b* to read the received identification code data, and preferably, verifies whether or not the identification code data IDa or IDb coincides with a card identification code data IDa or IDb or IDc which is previously registered in the PROM 17. Then, the image forming apparatus 1 aggregates image forming data such as copy count with respect to every identification code. The image forming data is transmitted to the IC card when a copying operation based on the IC card is completed.

Figure 3:
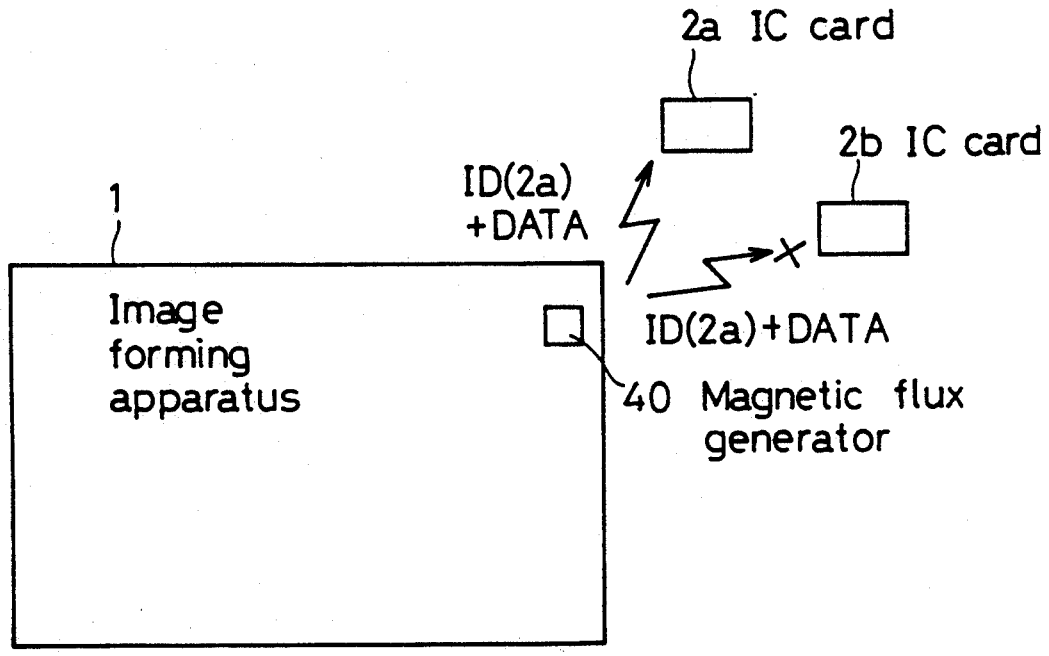
FIG. 3 shows a condition of a signal transmission from an image forming apparatus to an IC card in the system of FIG. 1.

FIG. 3 shows a case where a signal is transmitted from the image forming apparatus 1 to the IC card 2. In this case, a magnetic flux is generated by the magnetic flux antenna 40 of the image forming apparatus 1, and a signal is put on the magnetic flux to be transmitted. For example, the above-mentioned copy count data is transmitted from the image forming apparatus 1 to the IC card in the above-mentioned manner. Moreover, in a subsequently-described embodiment of FIG. 9, an ID transmission requesting signal is transmitted.

Embodiments of each operation of this system will hereinafter be described with reference to the flow charts of FIGS. 4 to 9. In the present invention, since image formation is performed without the IC card being attached to the image forming apparatus, the operation of the image forming apparatus has to be limited when a plurality of IC cards are brought in the vicinity of the image forming apparatus. The limitation is performed in each flow chart.

Figure 4:
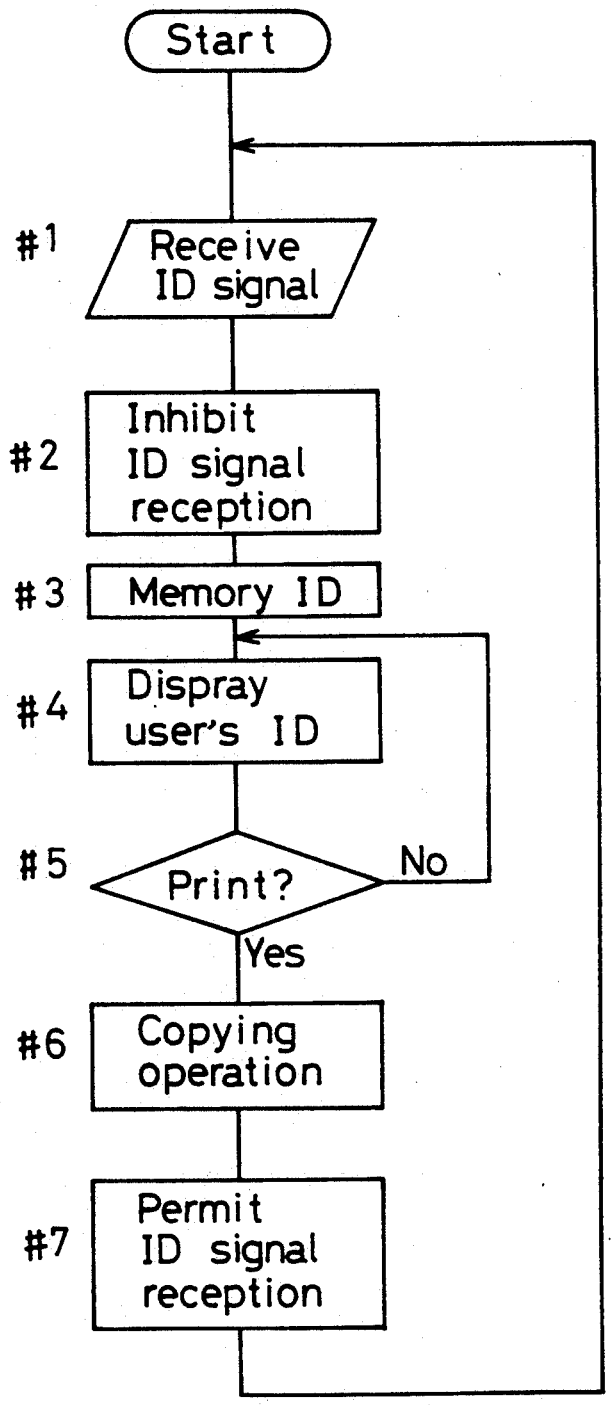
FIG. 4 is a flow chart of a first embodiment of operation flow of the image forming apparatus of the present invention.

First, in an embodiment of FIG. 4, at step #1, the image forming apparatus 1 receives an ID (identification code data) signal transmitted from the IC card. At step #2, receiving of an ID signal is inhibited in order to inhibit accepting of operation with respect to an IC card other than the IC card having the ID received at step #1. Then, at step #3, the ID signal received at step #1 is stored in a memory (the RAM 15). At step #4, the displaying portion 13 is caused to provide a display with respect to the ID signal received at step #1. Thereby, the user is informed of whether he or she can use the image forming apparatus 1 or not. By an operation of the user (by depressing the copy key of the operating portion 12), a copying operation is performed at step #6. After the copying operation is completed, receiving of an ID signal is permitted at step #7. Then, the process returns to step #1. In the embodiment of FIG. 4, when one ID signal is received, receiving of other ID signals is inhibited until a copying operation based on the ID signal is completed. The receiving of another ID signal is permitted after the copying operation is completed.

Figure 5:
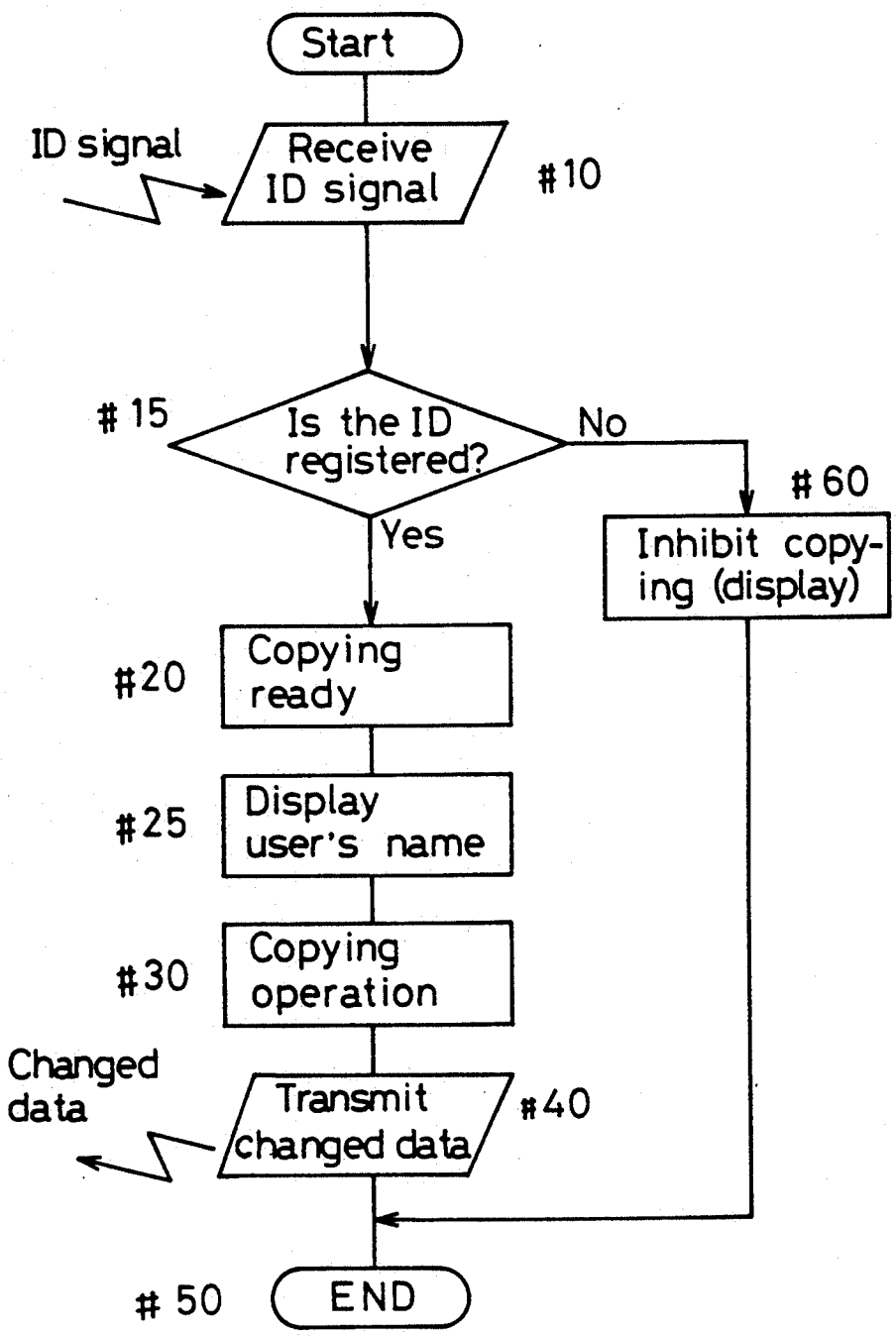
FIG. 5 is a flow chart of a second embodiment of operation flow of the image forming apparatus of the present invention.

Next, in an embodiment of FIG. 5, when an ID signal is received from the IC card at step #10, whether the ID signal coincides with an ID registered in the PROM 17 or not (that is, whether the user is registered or not) is verified at step #15. When it does not coincide with the registered ID copying is disabled at step #60, and after displaying that copying is impossible, the process proceeds to step #50 to finish the flow. When it is determined that the ID signal coincides with an ID registered in the PROM 17 as a result of the verification of step #15, the process proceeds to step #20, where the image forming apparatus is brought into a copying ready condition. At step #25, the user' name is displayed. Then, by an operation of the user, a copying operation is performed at step #30. Thereafter, at step #40, changed data such as a total copy count are transmitted to the IC card held by the user. Then, the process proceeds to step #50 to finish the flow.

Figure 6:
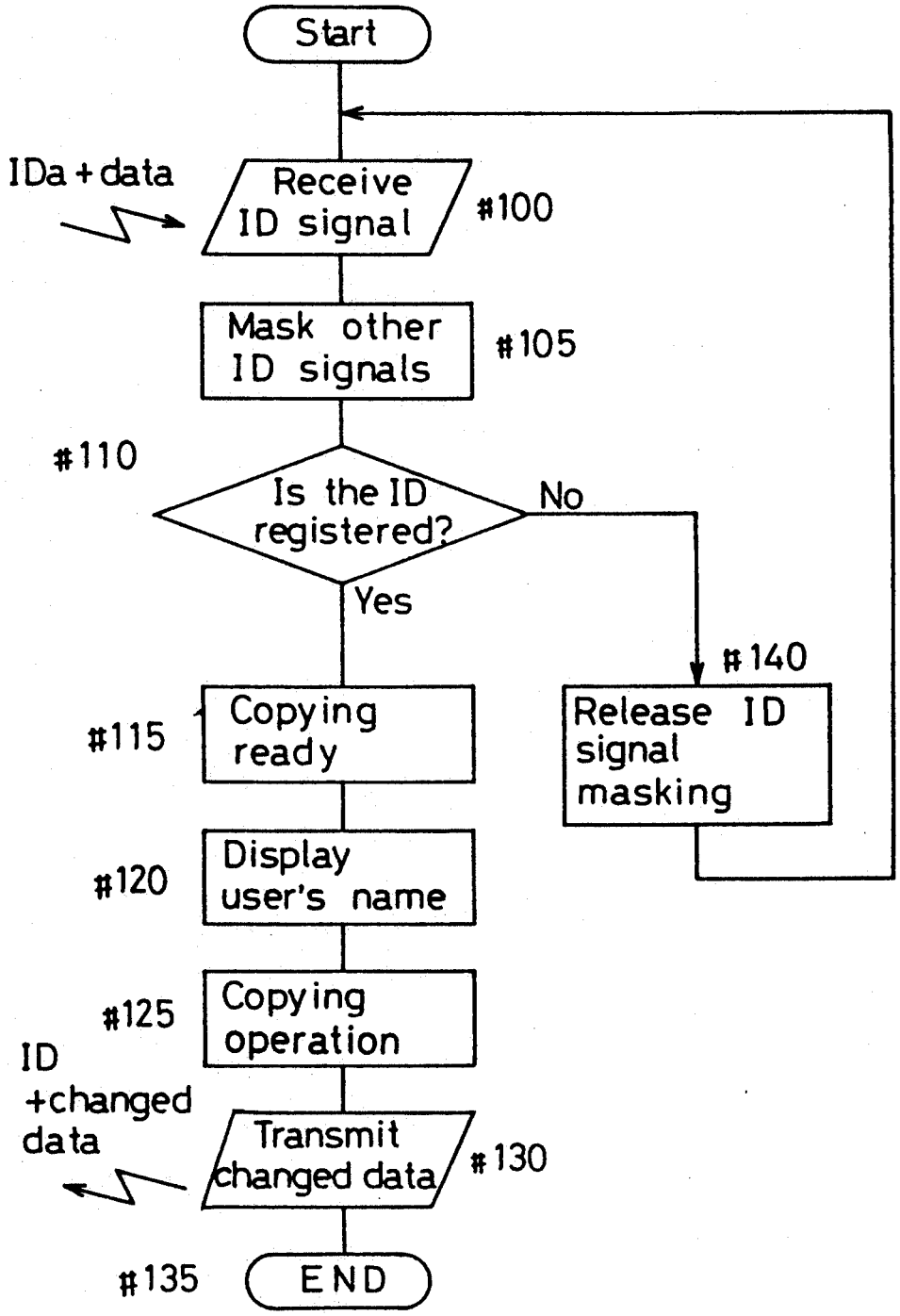
FIG. 6 is a flow chart of a third embodiment of operation flow of the image forming apparatus of the present invention.

Next, in an embodiment of FIG. 6, when an ID signal is received at step #100, other ID signals are masked at step #105. Then, at step #110, whether the ID signal received at step #100 coincides with a registered ID or not is verified. When it does not coincide, after releasing the masking of other ID signals at step #140, the process returns to step #100.

When it is determined that the ID signal coincides with the registered ID at step #110, the copying ready operation, the displaying of the user's name and a copying operation are performed at steps #115, #120 and #125, respectively. After the copying operation is completed, changed data including copy count data are transmitted to the IC card of the user who performed the copying operation.

Figure 7:
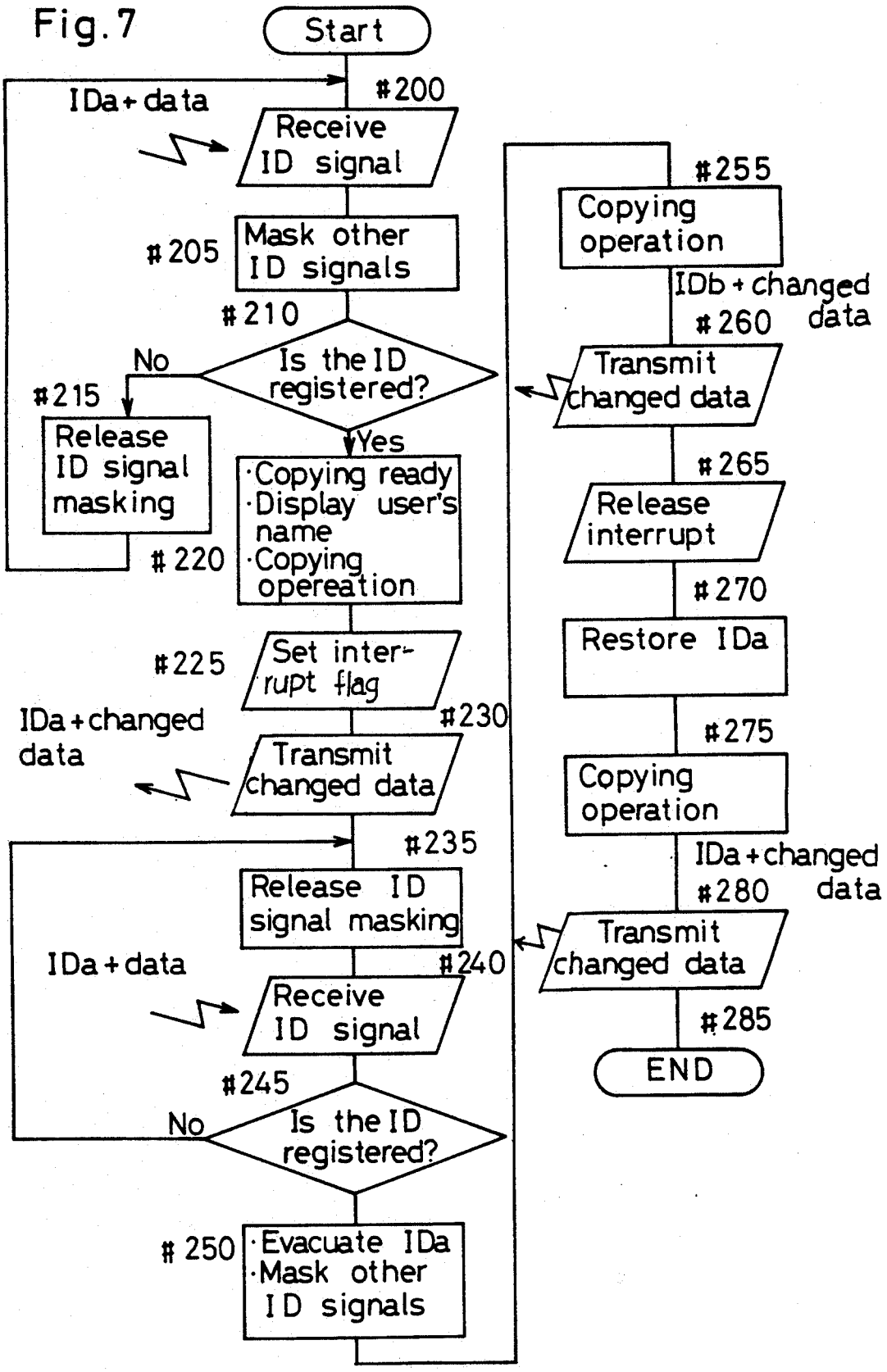
FIG. 7 is a flow chart of a fourth embodiment of operation flow of the image forming apparatus of the present invention.

Next, in an embodiment of FIG. 7, when, for example, the ID signal IDa from the IC card 2a is received at step #200, other ID signals are masked at step #205. Thereafter, at step #210, whether the IDa coincides with a registered ID or not is verified. When it does not coincide with a registered ID, after the masking of other ID signals is released with no copying operation being performed, the process returns to step #200. When the IDa coincides with a registered ID, the copy ready operation, the displaying of the user's name and a copying operation are performed at step #220. When an interrupt is applied, for example, by an operation of the interrupt key, during the operations of step #220, an interrupt flag is set at step #225, data which had been changed before the interrupt was applied are transmitted to the IC card 2a at step #230, and the masking of other ID signals is released at step #235. Then, at steps #240 to #250, a process of the interrupt from the IC card 2b is executed. After the interrupt process changed data are transmitted to the IC card 2b. Then, at step #265, the interrupt is released, and at steps #270 and #275, the process based on the IC card 2a is executed again. After the process is completed, changed data including copy count data are transmitted to the IC card 2a, and the flow is finished at step #285.

Figure 8:
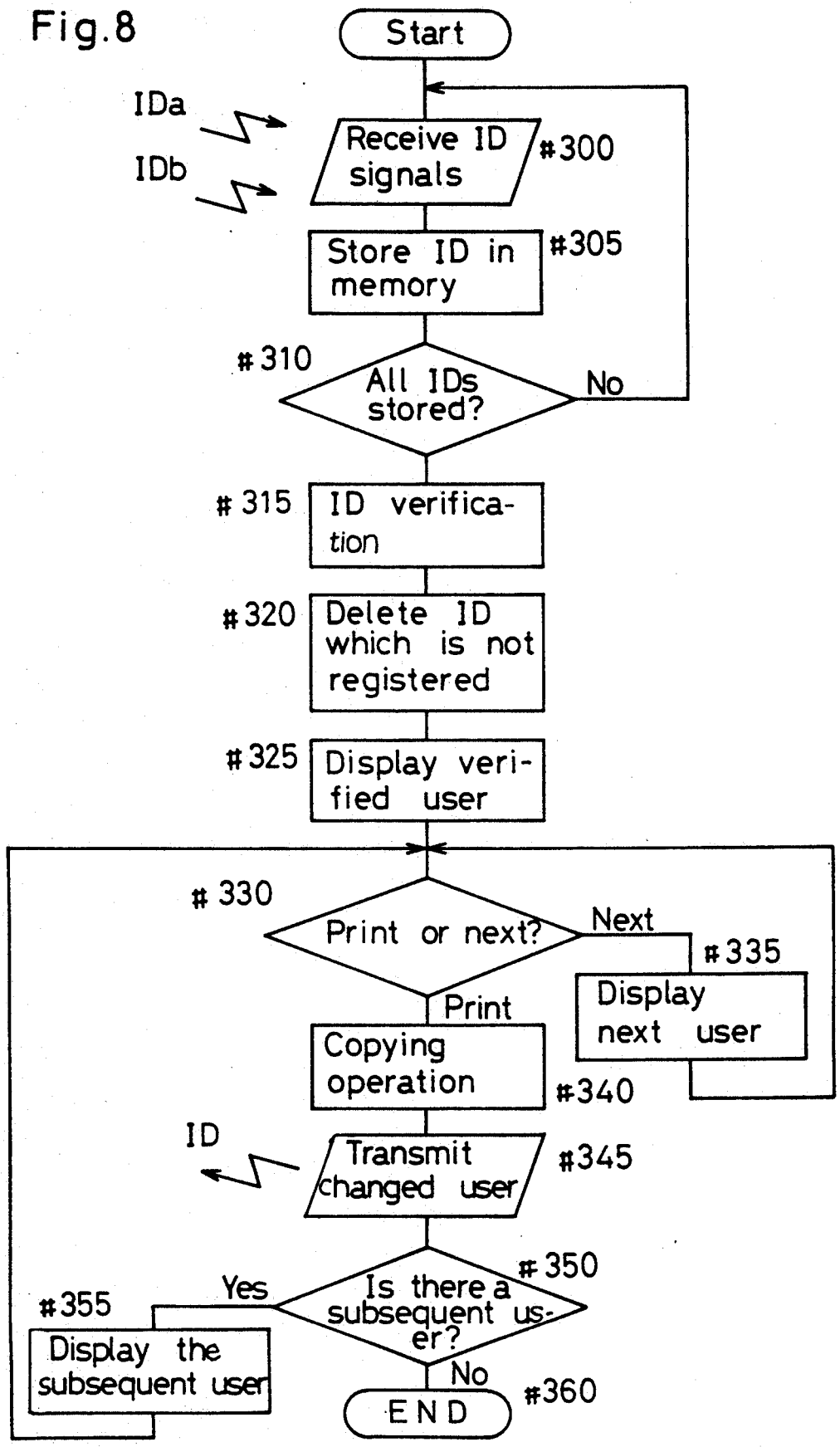
FIG. 8 is a flow chart of a fifth embodiment of operation flow of the image forming apparatus of the present invention.

Next, FIG. 8 shows a flow for a case where a plurality of persons are in the signal receivable range. At step #300, ID signals from both of the IC cards 2a and 2b are received. At step #305, the ID signals are stored in a memory. After all the ID signals are stored (step #310), the verification of the ID signals are performed at step #315. If an ID signal which does not coincide with a previously registered ID is found, the ID signal is deleted from the memory at step #320. Then, at step #325, the names of verified users are displayed in the order of 2a and 2b. This indicates the copying order of the users.

Then, at step #330, whether a printing key or a selecting key provided at the operation portion 12 of FIG. 1 is operated or not is determined. When the printing key is operated, a copying operation of the user holding the IC card 2a is performed at step #340. After the copying operation, changed data are transmitted at step #345. When the selecting key is operated at step #330, the copying order is changed from 2a to 2b since the selecting key is for selecting the copying order (copying turn is moved up every time the key is operated). Consequently, at step #335, the next user's name (that is, the name of the user of the IC card 2b) is displayed, and the process returns to step #330. Therefore, in this case, a copying operation of the user of the IC card 2b is performed at step #340. At step #350, whether or not there is another user subsequent to the user who performed a copying operation at step #340 is determined. When there is, after displaying the name of the subsequent user at step #355, the process returns to step #330. When there is not, the process proceeds to step #360 to finish the flow.

Figure 9:
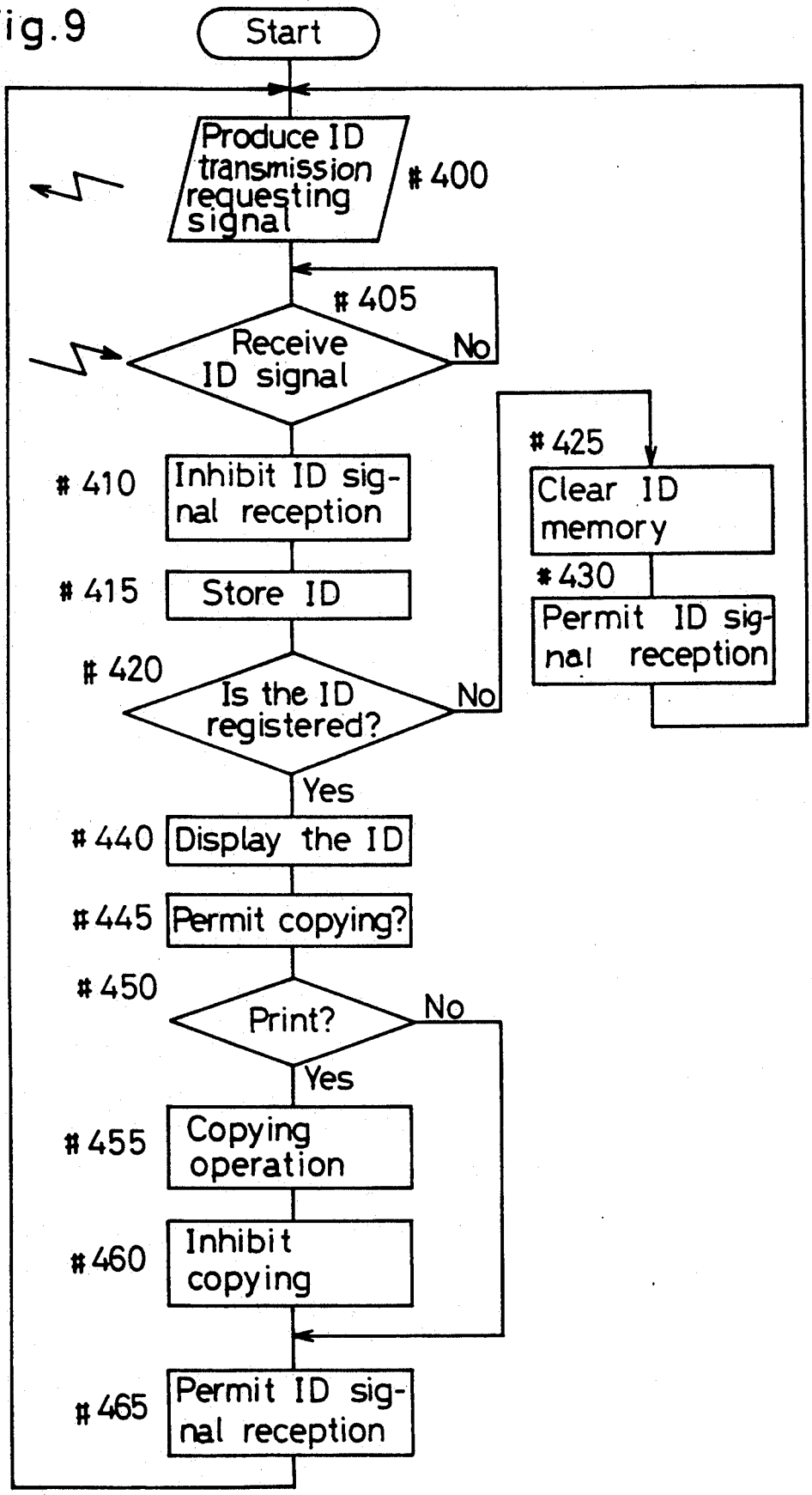
FIG. 9 is a flow chart of a sixth embodiment of operation flow of the image forming apparatus of the present invention.

Lastly, in an embodiment of FIG. 9, the ID transmission requesting signals are generated one after another by the image forming apparatus 1 at a predetermined interval at step #400. At step #405, an ID signal is received. After receiving of an ID signal is inhibited at the next step #410, the ID signal received at step #405 is stored in a memory at step #415. Then, at step #420, whether the ID signal stored in the memory is the requested ID signal or not (that is, whether the ID signal coincides with a registered ID or not) is verified. When it is not requested, the process proceeds to step #425, where the memory where the ID signal was stored is cleared. Then, after permitting the receiving of an ID signal at step #430, the process returns to step #400. When it is determined that the ID signal is requested at step #420, the ID is displayed at step #440. Then, after copying is permitted at step #445, a copying operation of the user of the ID is performed at steps #450 and #455. Thereafter, copying is inhibited at step #460, and receiving of an ID signal is permitted at step #465. Then, the process returns to step #400.

Obviously, many modifications and variations of the present invention are possible in light of the above teachings. It is therefore to be understood that within the scope of the appended claims, the invention may be practiced other than as specifically described.

What is claimed is:

1. An image forming system comprising:

an IC card including a signal transmitting portion for transmitting an identification code signal which specifies said IC card over a magnetic flux carrier; and an image forming apparatus including a signal receiving portion for receiving said identification code signal from said IC card without contact with said card, a display portion, and controlling means for causing said image forming apparatus to be brought into an image formation ready condition and causing said display portion to provide a display based upon said identification code signal when said identification code signal is received by said signal receiving portion.

2. An image forming system according to claim 1, wherein said image forming apparatus further includes an operation member for starting an image forming operation and wherein said controlling means performs a control operation for an image formation when said operation member is operated under a condition where said image forming apparatus is brought into said image formation ready condition by reception of a signal, and returns said image forming apparatus to a signal reception possible condition when the image forming operation is completed.

3. An image forming system comprising:

an image forming apparatus including a signal receiving portion and controlling means for causing said image forming apparatus to be brought into an image formation ready condition; and an IC card including a signal transmitting portion for transmitting a signal receivable by said signal receiving portion of said image forming apparatus without contacting said image forming apparatus, within a signal receivable range of said signal receiving portion, said controlling means controlling such that when at least two IC cards are brought into said signal receivable range, an identification code of one of said IC cards becomes ready first and is stored and the identification code of another of said at least two IC cards is not accepted until a predetermined operation has been completed.

4. An image forming system comprising:

an image forming apparatus including a signal receiving portion and controlling means for causing said image forming apparatus to be brought into an image formation ready condition; and an IC card including a signal transmitting portion for transmitting a signal receivable by said signal receiving portion of said image forming apparatus without contacting said image forming apparatus, within a signal receivable range of said signal receiving portion, wherein when at least two IC cards are brought into said signal receivable range, said controlling means provides a priority order to each of said IC cards, and after an image forming operation with respect to a first IC card has been completed, said controlling means brings said image forming apparatus into said image formation ready condition with respect to another IC card.

5. An image forming system comprising:

an IC card including a signal transmitting portion for transmitting a signal to specify said card over a magnetic flux carrier; and an image forming apparatus including a storing means for storing an identification code, a signal receiving portion, a display portion, and controlling means for determining whether or not an identification code represented by a received signal coincides with the identification code which is stored in said storing means and bringing said image forming apparatus into an image formation ready condition, and causing said display portion to provide a display based on an identification code of said IC card when an identification code represented by a received signal coincides with the identification code which is stored.

6. An image forming system according to claim 5, wherein said image forming apparatus further includes an operation member for starting an image forming operation and wherein said controlling means performs a control operation for an image formation when said operation member is operated under a condition where said image forming apparatus is brought into said image formation ready condition by a reception of a signal, and returns said image forming apparatus to a signal reception possible condition when said image forming operation is completed.

7. An image forming system comprising:

an image forming apparatus including storing means for storing an identification code, a signal receiving portion, and controlling means for determining whether or not an identification code represented by a received signal coincides with the identification code which is stored in said storing means and bringing said image forming apparatus into an image formation ready condition when an identification code represented by a received signal coincides with the identification code which is stored; and an IC card including a signal transmitting portion for transmitting a signal received by said signal receiving portion of said image forming apparatus without contacting said image forming apparatus, in a signal receivable range of said signal receiving portion, said controlling means controlling such that when at least two IC cards are brought into said signal receivable range, the identification code of one of said at least two IC cards becomes ready first and is stored and the identification code of another of said at least two IC cards is not accepted until a predetermined operation has been completed.

8. An image forming system comprising:

an image forming apparatus including a signal receiving portion, an interrupt operation member, and controlling means for causing said image forming apparatus to be brought into an image formation ready condition based on a first received signal and, when said interrupt operation member is operated during said ready condition, temporarily removing said image forming apparatus from said ready condition in order to cause it to enter another image formation ready condition; and an IC card including a signal transmitting portion for transmitting a signal received by said signal receiving portion of said image forming apparatus with no contact therewith in a predetermined signal receivable range of said signal receiving portion.

9. An image forming system according to claim 8, wherein said image forming apparatus further includes an operation member for starting an image forming operation and wherein said controlling means performs a control operation for an image formation when said operation member is operated under a condition where said image forming apparatus is brought into said image formation ready condition by a reception of a signal, and returns said image forming apparatus to a signal reception possible condition when said image forming operation is completed.

10. An image forming system according to claim 9, wherein when an interrupt is applied before an image forming operation with respect to a specified number of sheets has been completed, said controlling means interrupts the image forming operation to perform an interrupt operation, and after the interrupt operation is completed, returns said image forming apparatus to a condition in order to perform said image forming operation with respect to said specified number of sheets for a remaining number of sheets.

11. An image forming system according to claim 8, wherein said image forming apparatus includes storing means for storing an identification code and wherein said controlling means determines whether or not an identification code represented by a received signal coincides with the identification code stored in said storing means, and only when they coincide with each other, realizes said image formation ready condition.

12. An image forming system comprising:

an image forming apparatus including a signal receiving portion, an interrupt operation member, and controlling means for causing said image forming apparatus to be brought into an image formation ready condition based on a first received signal, and , when said interrupt operation member is operated under said ready condition, performing an interrupt operation; and an IC card including a signal transmitting portion for transmitting a signal received by said signal receiving portion of said image forming apparatus without contacting said image forming apparatus in a predetermined signal receivable range of said signal receiving portion, said controlling means controlling such that when a signal from one IC card is accepted, a signal from another IC card is not accepted, and when an interrupt is applied, acceptance of the signal from the other IC card is enabled.

13. An image forming system comprising:

an image forming apparatus including a first signal receiving portion, a first signal transmission portion for transmitting a signal over air, and first controlling means for bringing said image forming apparatus into an image formation ready condition based on a received signal and for causing said first signal transmitting portion to transmit image formation information; and an IC card including a second signal receiving portion and a second signal transmitting portion for performing reception and transmission of a signal with said image forming apparatus with no contact therewith in a signal receivable range of said image forming apparatus, storing means, and second controlling means for causing said second signal transmitting portion to transmit an identification code and for causing said storing means to store the image formation information transmitted from said image forming apparatus.

14. An image forming system according to claim 13, wherein said image formation information is the number of copy sheets where an image is formed.

15. An image forming system comprising:

an image forming apparatus including a first signal receiving portion, a first signal transmitting portion for transmitting a signal over air, and controlling means for causing said first signal transmitting portion to transmit an identification code transmission requesting signal, and when an identification code signal is received by said first signal receiving portion, after inhibiting an identification code signal which is received thereafter, determining whether or not said received identification code signal coincides with a transmission-requested identification code signal, and when they coincide with each other, bringing said image forming apparatus into an image formation ready condition and when they do not coincide with each other, releasing the inhibition of identification code signal reception; and an IC card including a second signal receiving portion and a second signal transmitting portion for performing reception and transmission of a signal with said image forming apparatus with no contact therewith in a signal receivable range of said image forming apparatus, and second controlling means for causing said second signal transmitting portion to transmit an identification code signal when said second signal receiving portion receives an identification code signal transmission requesting signal.

* * * * *